US005984576A

United States Patent [19]

Zetzsch

[11] Patent Number: 5,984,576

[45] Date of Patent: Nov. 16, 1999

[54] MOBILE DEMOUNTABLE LIQUID PROTECTIVE WALL FROM HORIZONTALLY S-SHAPE INDENTED PROFILE ELEMENTS, WHICH CAN BE STACKED ON TOP OF EACH OTHER

[76] Inventor: Klaus Zetzsch, Wormser Strasse 47, D-50677 Koln, Germany

[21] Appl. No.: 08/952,435

[22] PCT Filed: Apr. 26, 1996

[86] PCT No.: PCT/DE96/00732

§ 371 Date: Mar. 17, 1998

§ 102(e) Date: Mar. 17, 1998

[87] PCT Pub. No.: WO96/36773

PCT Pub. Date: Nov. 21, 1996

[30] Foreign Application Priority Data

May 16, 1995 [DE] Germany ..... 195 19 082

[51] Int. Cl.[6] ..... E02B 7/14

[52] U.S. Cl. ..... 405/110; 405/107; 405/114

[58] Field of Search ..... 405/15, 19, 21, 405/20, 31, 33, 52, 91, 102, 107, 111, 114, 115, 118, 110

[56] References Cited

U.S. PATENT DOCUMENTS

| | | | |
|---|---|---|---|
| 869,566 | 10/1907 | Hawkes | 405/20 |
| 1,002,161 | 8/1911 | Lambert | 405/33 X |
| 1,806,255 | 5/1931 | Groner et al. | 405/114 |
| 1,860,589 | 5/1932 | Noetzli | 405/114 |
| 2,566,748 | 9/1951 | Ringrose | 405/114 |
| 2,937,065 | 5/1960 | Harza | 405/107 X |
| 3,213,628 | 10/1965 | Serota | 405/111 |
| 3,886,751 | 6/1975 | Labora | 405/107 |
| 4,362,432 | 12/1982 | Conover | 405/33 |
| 4,363,433 | 12/1982 | Wagner et al. | 405/107 |
| 4,650,368 | 3/1987 | Bayer | 405/111 |
| 4,659,292 | 4/1987 | Sexton et al. | 405/107 X |
| 4,869,617 | 9/1989 | Chiodo | 404/6 |
| 5,091,247 | 2/1992 | Willibey et al. | 405/19 X |
| 5,118,217 | 6/1992 | Younes | 405/91 X |

FOREIGN PATENT DOCUMENTS

| | | | |
|---|---|---|---|
| 1527369 | 12/1989 | U.S.S.R. | 405/114 |

*Primary Examiner*—David Bagnell
*Assistant Examiner*—Jong-Suk Lee
*Attorney, Agent, or Firm*—John Lezdey & Assoc

[57] ABSTRACT

A mobile demountable flood barrier consists of individual stackable sections, the two longitudinal ends of which engage for securing purposes in a U-section arranged perpendicularly to the sections. The individual sections engage together by means of horizontal S-shape toothed projections on their upper side and lower side and thus transmit to their adjacent sections a part of the load caused by the pressure of the water which can act upon them.

6 Claims, 6 Drawing Sheets

MOBILE DEMOUNTABLE LIQUID PROTECTIVE WALL FROM HORIZONTALLY S-SHAPE INDENTED PROFILE ELEMENTS, WHICH CAN BE STACKED ON TOP OF EACH OTHER

BACKGROUND OF THE INVENTION

1. Field of the Invention

The invention relates to a mobile demountable liquid protective wall constructed of individual profile elements which can be stacked on top of each other, and which each engage for the purpose of fixing at both their ends into a U-profile, arranged in a vertical way to the profile elements.

2. Description of the Prior Art

Blockage units are known from the Swiss patent 70571, consisting of blockage girders, whose sealing amongst each other has to be done, however, via clay or any other sealing compound, which is costly in its deposition or attachment.

Furthermore, a demountable blockage unit for the flood protection is known from the German patent 3 420 405, whose sealings are designed in a frictional engaged way and which may cause problems when there is a higher existing water pressure. Furthermore, with this known solution, the load is only insufficiently distributed between the individual profile elements or the elements of the blockage unit, especially between the lower element, which is close to the ground, and the ground. For the support of the blockage unit in the cases of a longer span this patent provides the mounting of further side poles. These are set into the ground in tubular sparings, whereby these tubular sparings have to be constructed first via costly constructional measures.

German utility model teaches a mobile protective wall with rectangular boards, which are strengthened along their margins by a frame. Grooves are provided in the underground which receive the protective wall elements.

It is therefore the task of the invention to create a mobile, namely to be used anywhere, demountable protective wall for the defense of liquids, which distributes the pressure, which occurs because of the existing liquid, as evenly as possible onto the entire wall at a high closeness, without making it necessary to construct very costly constructional measures before the set up of the protection wall, but which makes it possible at the same time that also bigger widths can be spanned over with such a wall. This task is solved according to the invention by a liquid protective wall with the characteristics of claim 1.

Preferably, these elements each engage at both their longitudinal ends into an L-profile, which is arranged to the profile elements in a vertical way, for the purpose of fixing. The individual profile elements are thereby placed with their side, which is opposite to the liquid, at the flange of the L-profile running parallel to them. There, a rubber profile is provided for the purpose of sealing. To avoid a dumping of the profile elements to the side facing the liquid, a further L-profile of a smaller construction, which is attached with one side to the side of the L-profile, which is placed crosswise to the liquid protective wall, via long holes running in a diagonal way. Hereby it is made possible that the profile elements can be inserted in an easy manner into the groove, which is formed via the side of the big L-profile, which is placed along the liquid protective wall, and a side of the small L-profile. The insertion occurs in such a way that the small L-profile is moved in the long holes to the top in a diagonal way, the profile elements are inserted and after the insertion, the small L-profile is moved again to the profile elements with the aid of the long holes. That way a U-profile is created, in which the profile elements find themselves to be anchored, consisting of a longer leg, which is opposite to the liquid, a basis at the edge of the profile elements and a shorter leg, which is facing the elements. The profile elements run full of liquid from the side across the groove, which is created between them and the small L-profile as well as the big L-profile, as soon as the liquid starts rising at the wall. This also secures a good stability of the wall. With a falling liquid, the elements run empty again respectively.

In an embodiment according to the present invention, the individual profile elements are closed to the side, namely to the side fixing profile, with for example felt, gauze, a net or a cover plate in such a way that water can get in or get out, but not mud, dirt or any other polluting material.

As long as the profiles are not filled up, they are pushed or kept to the ground in an embodiment according to the present invention with the aid of a threaded rod, which is fixed in the ground and a swivel nut placed on the threaded rod, which engages into the upper edge of the liquid protective wall.

As an alternative the profile may also be embodied for example in the shape of a rigid, U-profile in one piece, for the side fixing of the profile elements, which form the liquid protective wall.

The profile elements are arranged on top of each other and are indented with each other at their upper- and lower side via S-shape indents, which are placed in a horizontal position. That way they transfer a part, namely about 50% of the load, which is caused by the pressure of the existing liquid, to their respective neighbor profiles.

An embodiment of the present invention provides a finishing piece to the upper edge of the liquid protective wall without a denticulation.

With a further embodiment of the invention, the lower profile element placed close to the ground engages into a ground section in a indented way and thereby also releases a part of the load, which has an effect on this profile element, via the ground section onto the subsoil. The ground section is provided with a sealing, which overlaps a piece each at the edges of the ground section and which takes up the total width of the ground section below the ground section. The ground section including the sealing is inserted into a bearing device for example a double-T-bearing, which is fixed in the subsoil, and it is sealed here in a form close, tight manner. Hereby its sealing characteristic is increasing steadily with rising pressure. The bearing device is sealed in a channel, which is placed below the soil.

In case the liquid protective wall is not in use, an embodiment of the present invention provides that the bearing device for example the double-T-bearing or something of that kind, which is set in the subsoil, can be covered via a plate or a sheet metal or something of that kind.

In an embodiment this cover plate or something of that kind is deposited on the upper edges of the bearing device for example the double-T-bearing or something of that kind.

Preferably, in the S-shape dents, which are placed in a horizontal way, at the respective upper- and lower sides of the profile elements, form close sealings are deposited, which are pressed due to the pressure of the liquid having an effect on them into the groove angle, which results from the S-shape dent of the indent, which is placed in a horizontal way, between two neighboring profiles, and thereby steadily improve their sealing characteristic with rising pressure.

In a further embodiment of the present invention, the liquid protective wall is supported for the purpose of keeping up the stability in certain distances, which are dependent on the pressure of the liquid to be expected, via mobile supports on the side, which is opposite to the existing liquid, in such a way that the forces, which have an effect on the liquid protective wall, are guided onto the subsoil.

Preferably these mobile supports are embodied as elements in the shape of, for example rectangular triangles. The distance, within which a positioning of these mobile supports is necessary, varies between 4.10 m with an existing liquid of 0.40 m in height at the wall and 2.43 m with a height of the liquid of 2.00 m. It is thereby always secured that the wall never exceeds the allowed deflection of 1 part in 300 according to DIN 4113 at any position.

The advantage of the liquid protection wall according to the present invention lies in the fact that the device can be easily mounted or demounted without making costly constructional measures necessary before the set up of the wall. Because of the chosen form close sealings, which press into the gap angle of the horizontal S-indent, a high sealing of the entire wall is achieved without exposing the sealings to a high pressure. Via the S-shape indent in a horizontal way of the profile elements an even distribution of the load over the entire wall is achieved. By means of a ground section inserted into a bearing device for example a double-T-bearing, a direct particular distribution of the weight onto the subsoil can be achieved further in an embodiment of the present invention. Longer spans between the individual vertical fixings, which are designed in a U-profile shape, can be achieved via mobile supports.

BRIEF DESCIPTION OF THE DRAWINGS

In the following, embodiments are discussed and explained by means of the attached drawings. These drawings show in:

FIG. 1 a cross-sectional illustrated embodiment according to the present invention with the indent of the lower profile element to the ground fixing device, with the indent positioned to the profile element above it, at the same time, FIG. 2 a cross-sectional illustrated embodiment of a finishing piece of a profile element for the protection against mud from the side, namely to the side fixing profile, FIG. 3 a cross-sectional illustrated embodiment of a ground piece without sealing, FIG. 4 a cross-sectional illustrated embodiment of a sealing profile, FIG. 5 a cross-sectional illustrated embodiment of a sealing profile for the purpose of sealing the ground piece according to the invention, FIG. 6 a cross-sectional illustrated embodiment of an individual profile element, which can be stacked on top of each other, with an S-shape dent of the indents in a horizontal way at the upper side and the lower side according to the invention, FIG. 7 a side view of an embodiment of the mobile support from elements in the shape of a rectangular triangle, FIG. 8 a cross-sectional illustrated embodiment of a covered bearing device, which is inserted into the subsoil, FIG. 9 a cross-sectional illustrated embodiment of the bearing device, which is inserted into the subsoil, without a cover, FIG. 10 a cross-sectional illustrated embodiment of the present invention, into which a lower profile element and a ground piece with a sealing is inserted into bearing device, which is inserted into the subsoil, FIG. 11 a top view cross section of an embodiment of the side profile for the fixing of the profile element, which forms the liquid protective wall, FIG. 12 a front view of the profile of the fixing according to FIG. 11 in the direction of the view parallel to the liquid protective wall seen from the interior side with a closed, namely moved to the bottom right, smaller L-profile, and FIG. 13 a front view of the profile of the fixing according to FIG. 11 in the direction of the view parallel to the liquid protective wall seen from the interior side with an open, namely moved to the top left, smaller L-profile.

DESCRIPTION OF THE PREFERRED EMBODIMENTS

FIG. 1 shows an embodiment of the present invention with the indent 101 of the lower profile element 102 to the ground piece 103 with the simultaneous S-shape indent 104 to the profile element 105 placed on top. The sealing profiles 106 and 107 engage here into the gap angle 108, resulting from the S-shape dent of the indent 104 placed in a horizontal position, and 109 between the two neighboring profile elements 102 and 105. Towards the ground, there is also a sealing profile 110, with which the ground piece occludes in a tight way towards the bottom.

FIG. 2 shows an illustration of an embodiment of the finishing piece 201 of a profile element for the mud defense from the side, namely toward the side fixing profile. This finishing piece 201 allows water to get in or get out, but it does not allow the same for mud or any other polluting material, and due to that the profile does not get dirty from within.

FIG. 3 shows an illustration of an embodiment of the bottom fixing device 301 without sealings. The lower profile element can engage thereby with its denticulation between a profile limitation 302 and a an edge 303.

Figure 1:
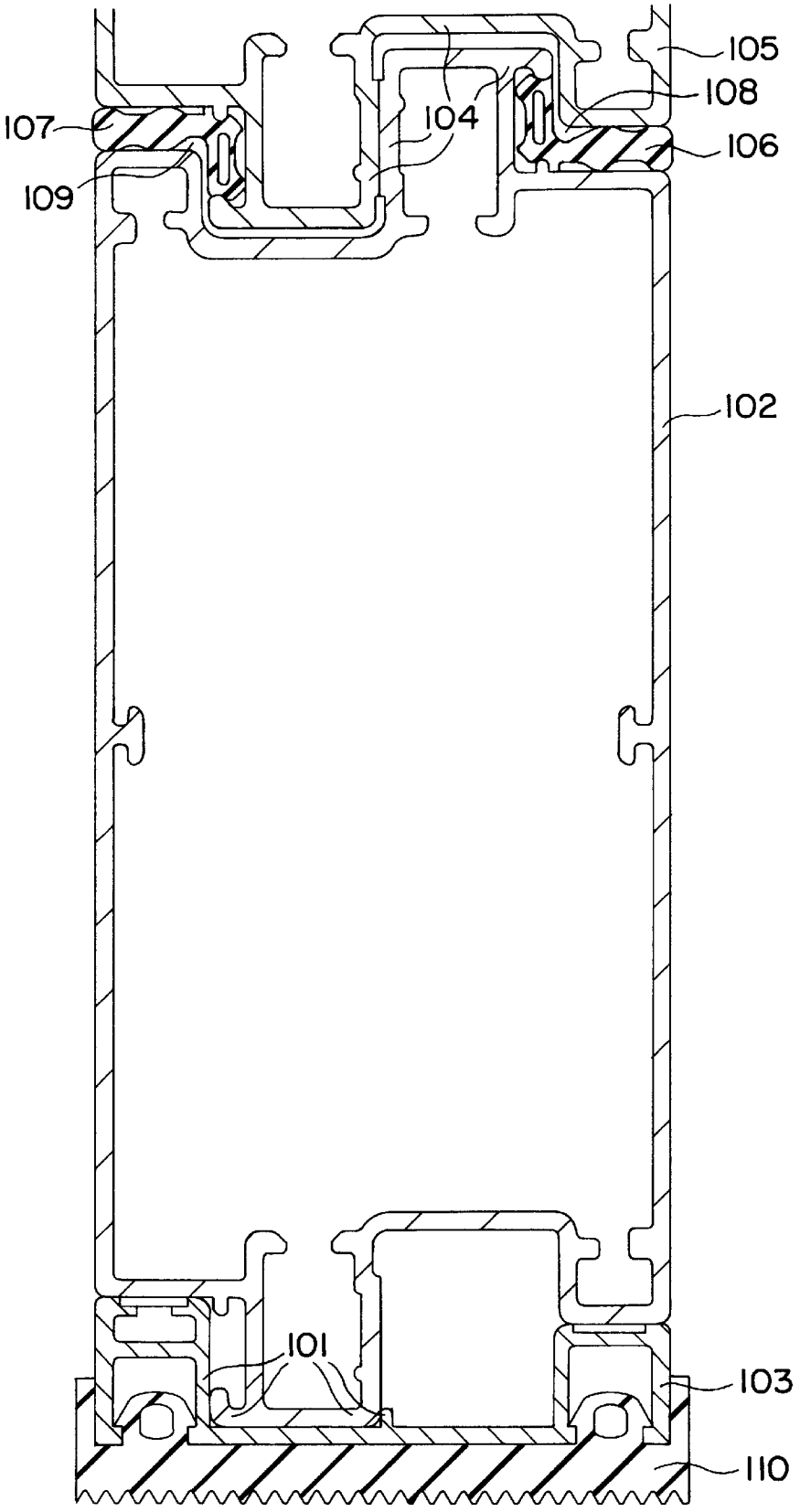
Figure 2:
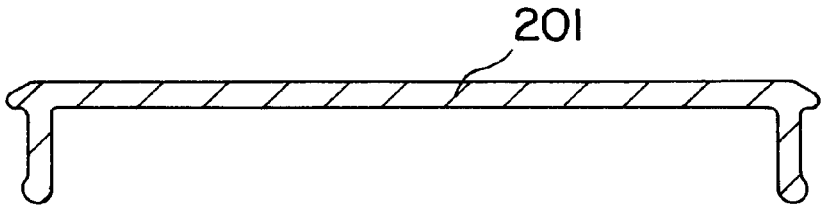
Figure 3:
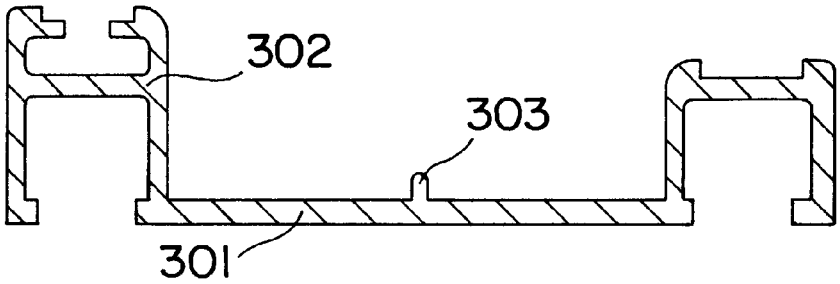
Figure 4:
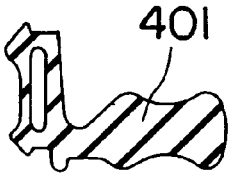
FIG. 4 shows an illustration of an embodiment of a sealing profile 401, as it is preferably attached for the form close sealing in the groove between the profile elements.
Figure 5:
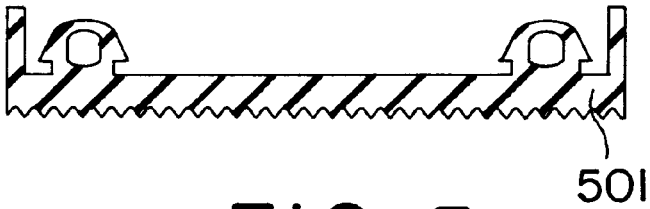
FIG. 5 shows an illustration of an embodiment of a sealing profile 501 for the sealing of a bottom fixing device according to the present invention.
Figure 6:
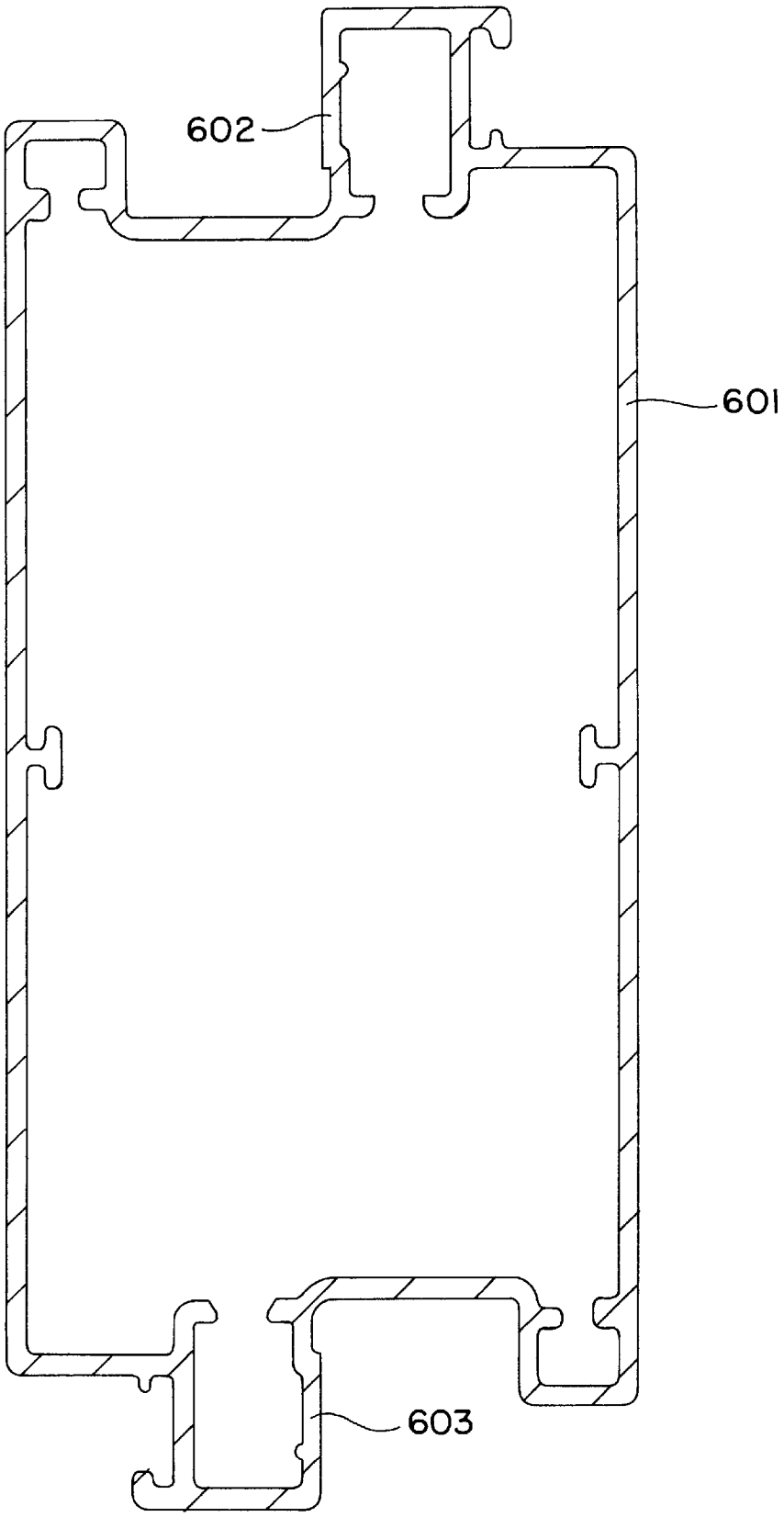

FIG. 6 shows an illustration of an embodiment of an individual profile element 601, which can be stacked on top of each other, with an S-shape dent of the indent in a horizontal way at the upper side 602 and an S-shape dent of the indent in a horizontal way at the lower side 603 according to the present invention. The indents of elements positioned on top of each other are in an offset and engage into each other in a reciprocal way.

Figure 7:
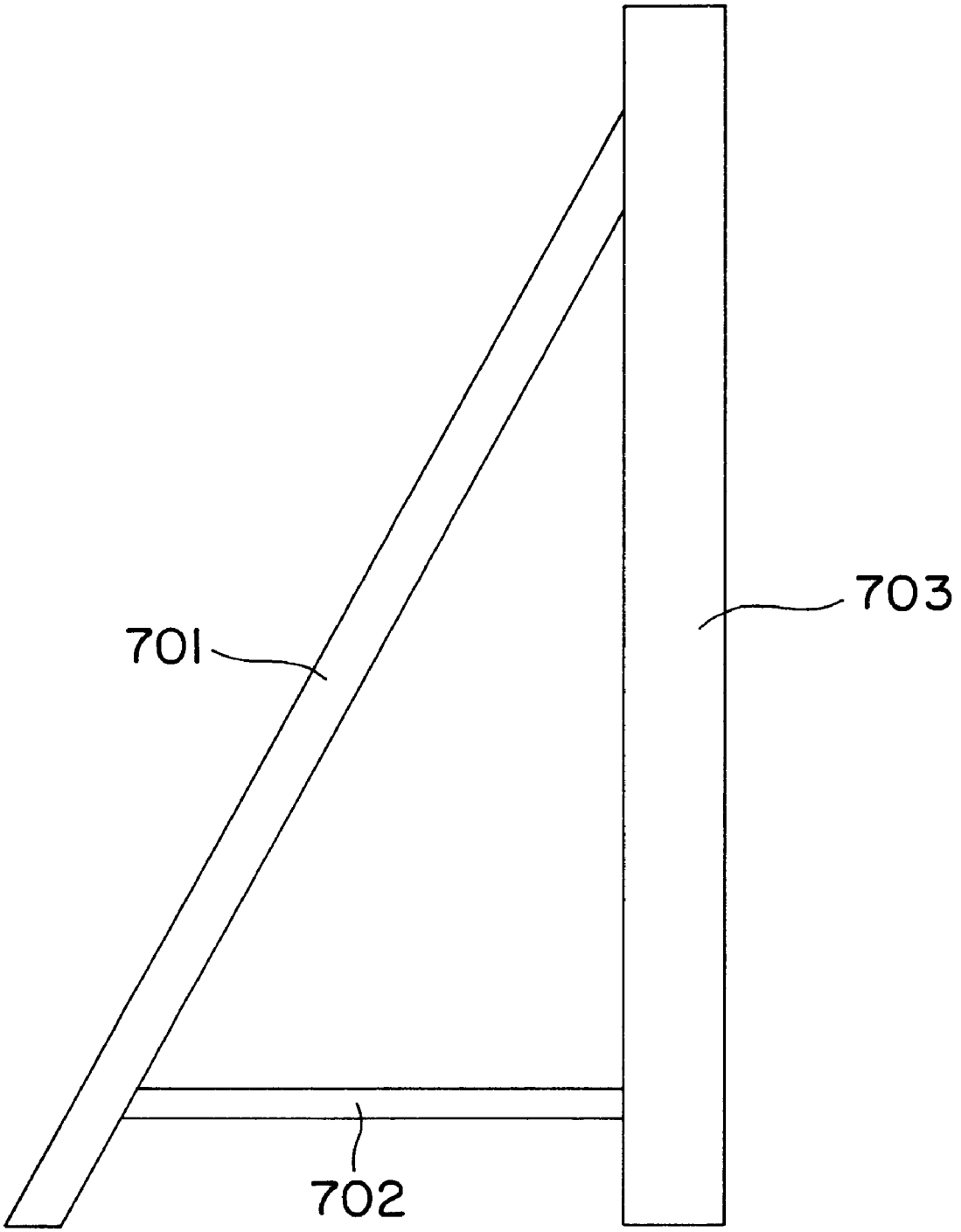

FIG. 7 shows an illustration of an embodiment of a mobile support from elements in the shape of a rectangular triangle. Hereby the support is formed of a thicker sloping, preferably seamless steel tube 701 and a thinner horizontal, preferably also seamless steel tube 702, which supports the protective wall 703.

Figure 8:
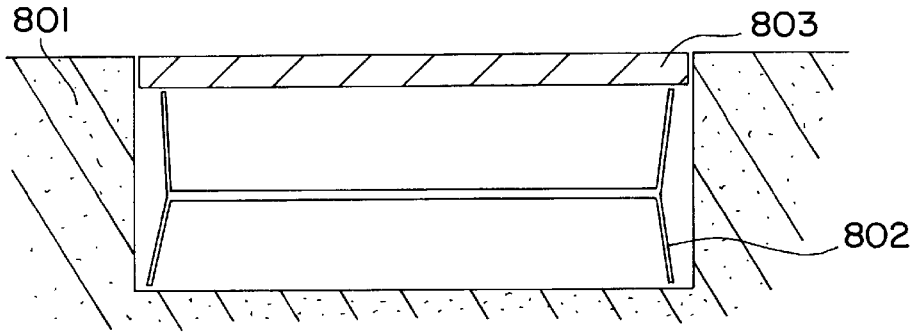

FIG. 8 shows an illustration of an embodiment of a bearing device 802, which is set into the subsoil 801 and covered via a plate or something of that kind 803.

Figure 9:
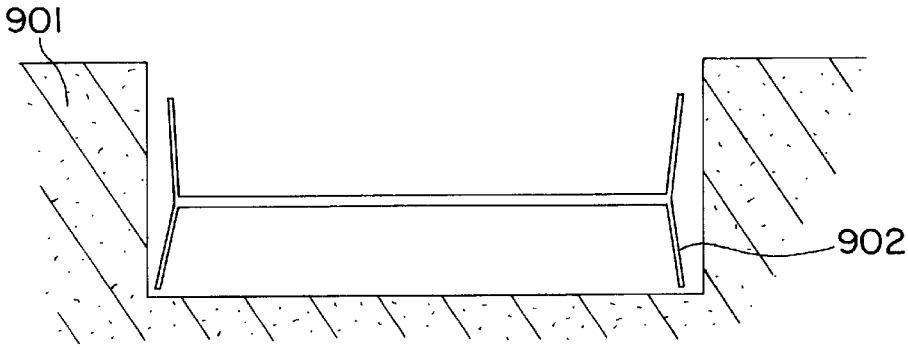

FIG. 9 shows an illustration of an embodiment of a bearing device 902, which is set into the subsoil 901 but not covered.

Figure 10:
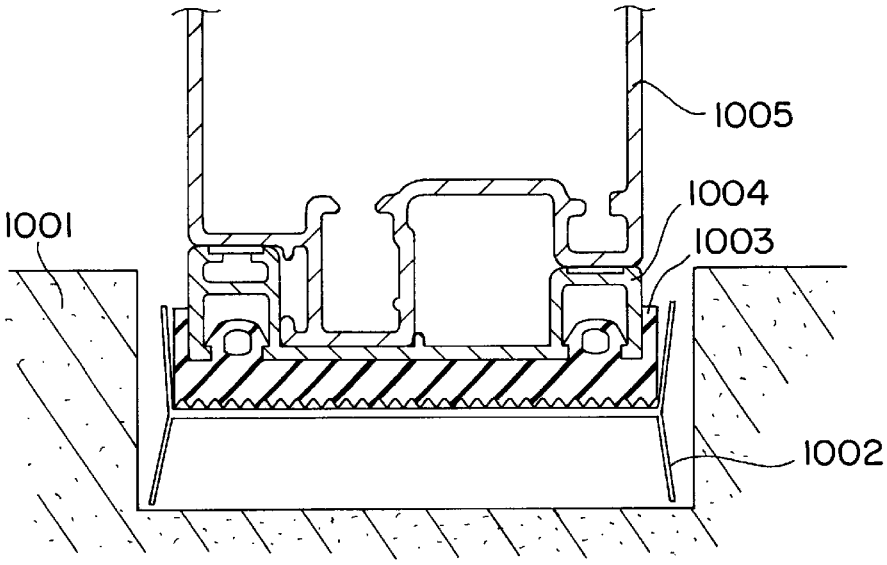

FIG. 10 shows an illustration of an embodiment of the present invention, in which a lower profile element 1005 and a ground piece 1004 with sealing 1003 is inserted into a bearing device 1002, which is set into the subsoil 1001.

Figure 11:
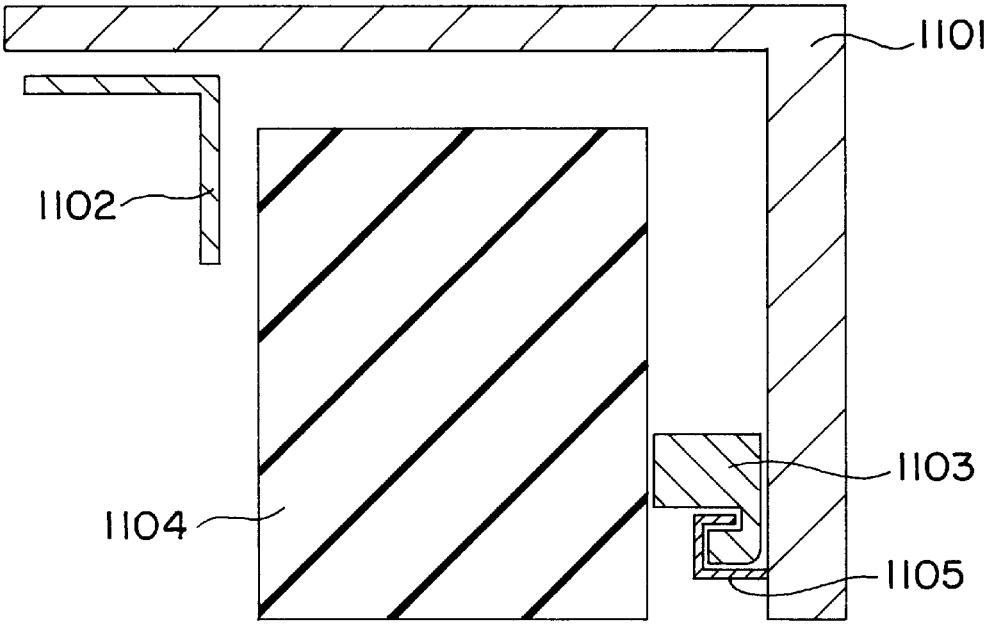

FIG. 11 shows a cross section of an embodiment of the side profile for the fixing of the profile elements, which form the liquid protective wall. The L-profile 1101 has a shoulder

1105 positioned parallel to the side facing the liquid protective wall, the shoulder supports a sealing profile 1103. This sealing profile 1103 secures that no water can get into the space behind the wall via the side fixing profile of the liquid protective wall. Towards the side of the liquid, a smaller L-profile 1102 prevents the wall from dumping into that direction. The profile elements 1104 fill up with liquid from the side via the groove resulting from them and the small L-profile 1102 as well as the large L-profile 1101 as soon as the liquid starts rising at the wall. This also secures a good stability of the wall. When the liquid is falling, the respective elements run empty accordingly.

Figure 12:
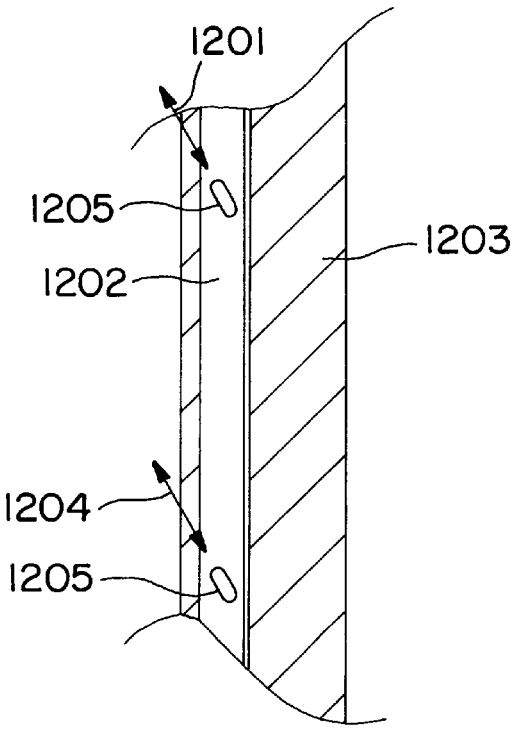

FIG. 12 shows a view of the profile for the fixing according to FIG. 11 in the direction of view parallel to the liquid protective wall from the inside. The smaller L-profile 1202 is fixed onto the larger L-profile 1203 via screws, placed in the long holes 1205 of the smaller profile 1202, or via bolts. Because of this kind of fixing, the smaller profile 1202 can be moved back and forth in relation to the larger profile 1203 in the direction of the arrow 1201 and 1204. Here it is seen shifted in the closed state, namely closer towards the side surface, which is parallel to the liquid protective wall, of the larger profile 1203.

Figure 13:
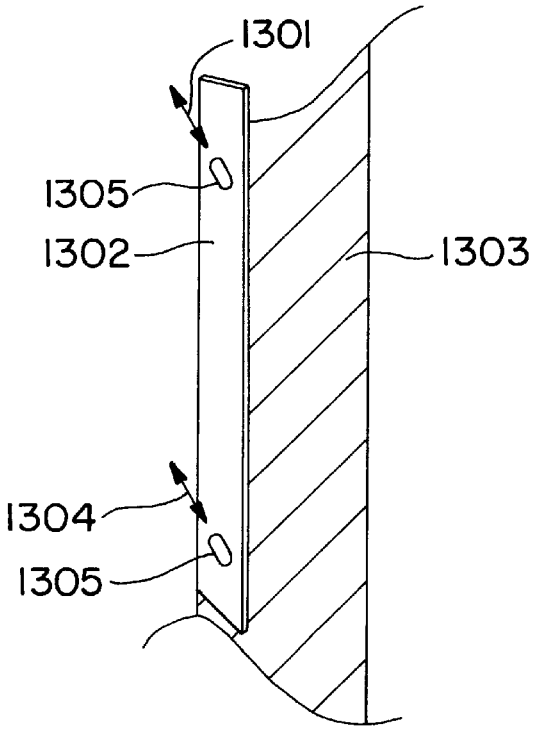

FIG. 13 shows a view of the profile for the fixing according to FIG. 11 in the direction of view parallel to the liquid protective wall from the inside. The smaller L-profile 1302 is fixed onto the larger L-profile 1303 via screws, placed in the long holes 1305 of the smaller profile 1302, or via bolts. Because of this kind of fixing, the smaller profile 1302 can be moved back and forth in relation to the larger profile 1303 in the direction of the arrow 1301 and 1304. Here it is seen shifted in the open state, namely further from the side surface, which is parallel to the liquid protective wall, of the larger profile 1303.

I claim:

1. A mobile demountable liquid protective wall constructed of individual profile elements which can be stacked on top of each other, wherein each of the profile elements engage for the purpose of fixing at both longitudinal ends of the profile elements into a U-shaped profile, arranged in a vertical way to the profile elements, the improvement comprising a plurality of individual profile elements further comprising an upper side, a lower side, and S-shaped dents, said S-shaped dents further comprising a gap angle wherein said individual profile elements engage into each other in an indented way at said upper side and said lower side through said S-shaped dents when said profile elements are placed in a horizontal way in relation to each other whereby a transfer of a part of a load is caused, said load being caused by the pressure of a liquid; a ground piece and means for fixing said around piece to a ground; said profile element that is lowest to the ground engages into said ground piece in an indented manner thereby transferring a part of the load, through the lowest profile element through the ground piece into the ground; form close sealings whereby said close sealings are attached in said S-shaped dents when placed in a horizontal way at said upper or lower side of the profile elements, when said sealings are pressed between said profile elements with said liquid exerting pressure on said profile elements through said gap angle which is created by said S-shape dent when placed in a horizontal way and which thereby further improves the sealing characteristic of said sealings with rising pressure.

2. The device according to claim 1, whereby said means for fixating said ground piece to the ground comprises a bearing device, said bearing device having means for fixing said bearing device to the ground and said bearing device having means for receiving said ground piece when inserting said ground piece into said bearing device.

3. The device according to claim 2 further comprising a cover, wherein an area of exemption is provided in the ground, said bearing device being inserted into said area of exemption and said cover covers said bearing device in said area of exemption.

4. The device according to claim 2 wherein said ground piece further comprises a plurality of edges and a sealing means, said sealing means overlapping at least one of said edges of the ground piece said sealing means taking up at least one part below said ground piece whereby said sealing means finishes in a form close manner with said bearing devices, said bearing device is inserted into the ground and thereby increasing the sealing characteristic of said sealing means with rising pressure.

5. The device according to claim 1 further comprising mobile supports, said supports being attached on the side of said liquid protective wall opposite to the existing liquid for keeping up the stability of said protective wall at a plurality of intervals, said intervals being dependent on the expected pressure of the liquid whereby the forces having an effect on the liquid protective wall are transferred into the ground.

6. The device according to claim 5 wherein said mobile supports consist of elements in the shape of rectangular triangles.

* * * * *